US007821483B2

(12) United States Patent
Su et al.

(10) Patent No.: US 7,821,483 B2
(45) Date of Patent: Oct. 26, 2010

(54) INTERFACE CIRCUIT FOR DATA TRANSMISSION AND METHOD THEREOF

(75) Inventors: Hsiao-Lan Su, Hsinhua (TW); Pen-Hsin Chen, Hsinhua (TW); Yu-Jui Chang, Hsinhua (TW); Ying-Lieh Chen, Hsinhua (TW); Lin-Kai Bu, Hsinhua (TW)

(73) Assignee: Himax Technologies Limited, Tainan County (TW)

( * ) Notice: Subject to any disclaimer, the term of this patent is extended or adjusted under 35 U.S.C. 154(b) by 1028 days.

(21) Appl. No.: 11/438,230

(22) Filed: May 23, 2006

(65) Prior Publication Data

US 2007/0273631 A1 Nov. 29, 2007

(51) Int. Cl.
*G09G 3/36* (2006.01)

(52) U.S. Cl. ..... 345/98; 345/99

(58) Field of Classification Search ..... 345/98–99
See application file for complete search history.

(56) References Cited

U.S. PATENT DOCUMENTS

| | | | | |
|---|---|---|---|---|
| 6,335,718 | B1 * | 1/2002 | Hong et al. | 345/98 |
| 7,307,613 | B2 * | 12/2007 | Teshirogi et al. | 345/98 |
| 7,456,814 | B2 * | 11/2008 | Lee et al. | 345/96 |
| 7,474,706 | B2 * | 1/2009 | Wang et al. | 375/295 |
| RE40,864 | E * | 7/2009 | Hong et al. | 345/98 |
| 2003/0030642 | A1 * | 2/2003 | Chen et al. | 345/519 |

* cited by examiner

*Primary Examiner*—Amare Mengistu
*Assistant Examiner*—Gene W Lee

(57) ABSTRACT

An interface circuit for data transmission and the method thereof is described. The interface circuit includes a transmitter providing data through first data signals during the data periods corresponding to rising and falling edges of a clock signal, a transition detection unit selectively asserting a detection signal in response to the number of the first data signals having transitions between every two adjacent data periods, a transition reduction unit generating second data signals by outputting the inverted and non-inverted first data signals respectively when the detection signal is asserted and de-asserted, and a receiver restoring the data from the second data signals and the detection signal.

9 Claims, 3 Drawing Sheets

INTERFACE CIRCUIT FOR DATA TRANSMISSION AND METHOD THEREOF

FIELD OF THE INVENTION

This invention relates to an interface circuit, and more particularly, to an interface circuit between a timing controller and source driver of a liquid crystal display.

BACKGROUND OF THE INVENTION

FIG. 1 illustrates a circuitry of a conventional LCD. The conventional LCD includes a group of source drivers 56, a group of gate drivers 54, a LCD panel 58 and a timing controller 52. As shown in FIG. 1, a video processing system 50 transmits RGB data and control signals including a clock signal, a horizontal synchronizing signal and a vertical synchronizing signal to a timing controller 52. The timing controller 52 rearranges and transfers the RGB data, and outputs essential control signals to the source driver 56.

An RSDS (reduced swing differential signaling) interface circuit or TTL (single edge of transistor logic) interface circuit is typically used between the timing controller 52 and the group of source drivers 56. In the RSDS or TTL interface, each value of the pixel of red, green or blue is represented by 6 bits, which necessitates 18 wire lines for RGB data transmission. With the demands of higher color resolution and image quality, the number of bits of the pixel value should be increased, for example, to 8 or 10. However, increasing the bits of the pixel value will necessitates more wire lines and therefore result in a larger power consumption, more serious EMI (electromagnetic interference) effect and higher fabrication cost.

SUMMARY OF THE INVENTION

It is therefore an aspect of the present invention to provide an interface circuit for data transmission and the method thereof in which a mechanism of dual edges is used to reduce the number of wire lines.

It is therefore another aspect of the present invention to provide an interface circuit for data transmission and the method thereof in which the number of transitions of the transmitted signal can be reduced by automatically detecting the number of transitions so that the power consumption can be reduced and the EMI effects can also be lowered.

In order to achieve the aforementioned aspects, the present invention provides an interface circuit including a transmitter, a transition detection unit, a transition reduction unit and a receiver. The transmitter provides data through first data signals during the data periods corresponding to rising and falling edges of a clock signal. The transition detection unit selectively asserts a detection signal in response to the number of the first data signals having transitions between every two adjacent data periods. The transition reduction unit generates second data signals by outputting the inverted and non-inverted first data signals, respectively, when the detection signal is asserted and de-asserted. The receiver restores the data from the second data signals and the detection signal.

According to the embodiment of the present invention, the detection signal is asserted when the number of the first data signals having transitions is greater than a threshold. The data restored by the receiver is substantially the same as the data provided by the transmitter. The transmitter and the receiver are located in a timing controller and a source driver of an LCD, respectively.

To achieve the aforementioned aspects, the present invention provides a method for data transmission comprising the following steps. First, data is provided through first data signals during data periods corresponding to rising and falling edges of a clock signal. A detection signal is then selectively asserted in response to the number of the first data signals having transitions between every two adjacent data periods. The second data signals are then generated by outputting the inverted and non-inverted first data signals, respectively, when the detection signal is asserted and de-asserted. The data are restored from the second data signals and the detection signal.

According to the embodiment of the present invention, the detection signal is asserted when the number of the first data signals having transitions is greater than a threshold. The data restored is substantially the same as the data provided. The data is provided and restored by a timing controller and a source driver of an LCD, respectively.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
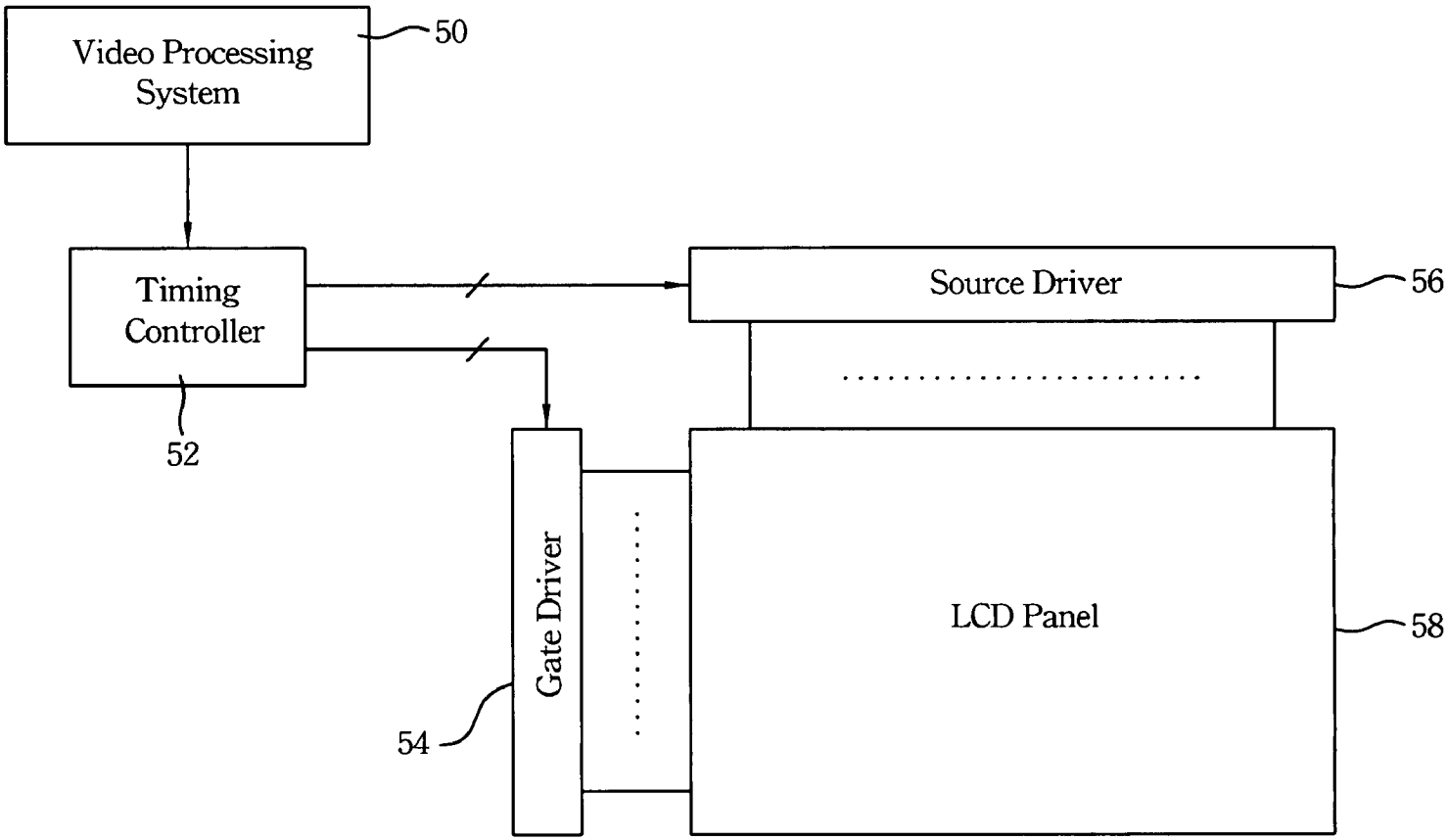
Figure 1 (Prior Art)
FIG. 1 illustrates a circuitry of a conventional LCD.

While the present invention is susceptible of embodiment in various forms, there are presently preferred embodiments shown in the drawings and will hereinafter be described with the understanding that the present disclosure is to be considered as an exemplification of the invention and is not intended to limit the invention to the specific embodiment illustrated.

Figure 2:
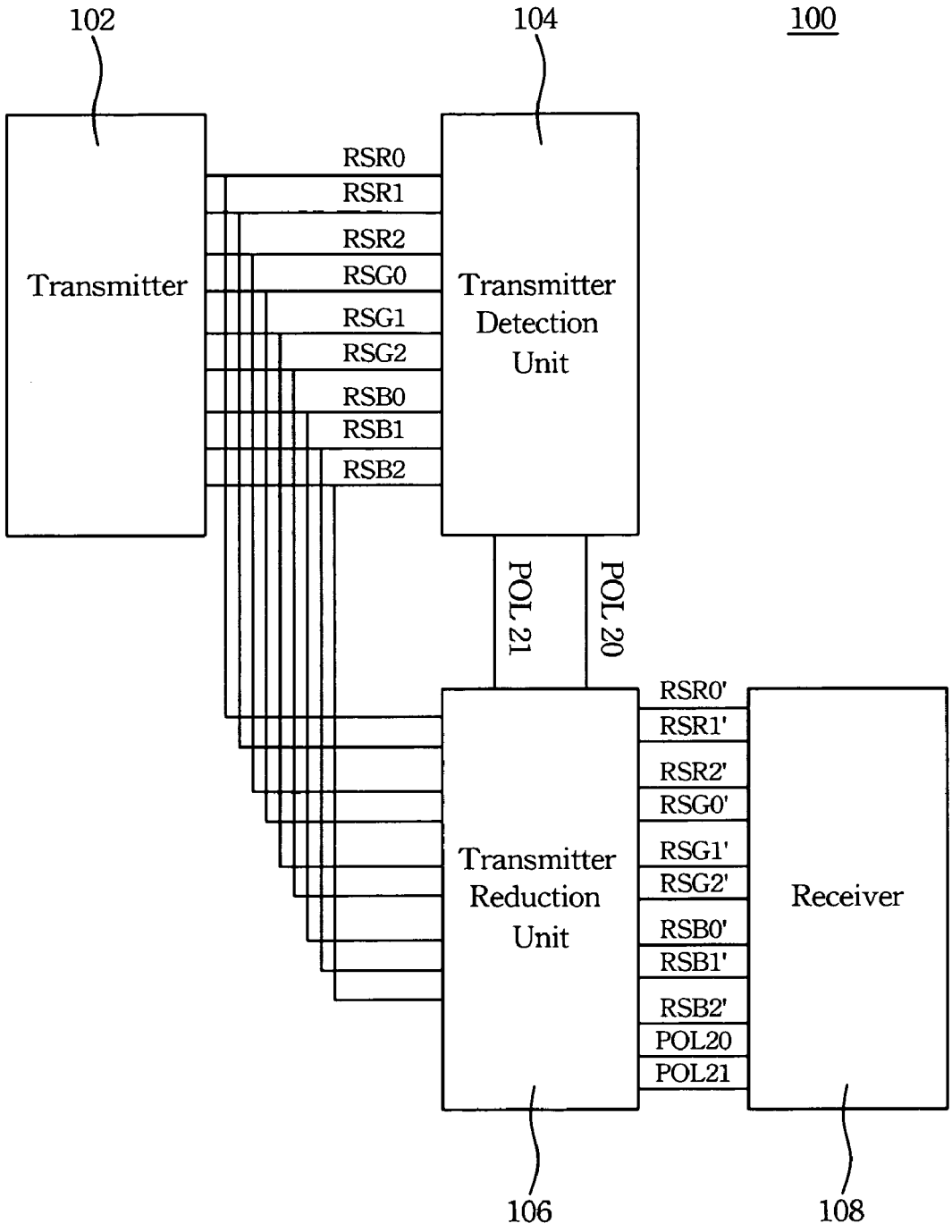
FIG. 2 shows an interface circuit according to the preferred embodiment of the present invention.

FIG. 2 shows an interface circuit according to the preferred embodiment of the present invention. The interface circuit 100 includes a transmitter 102, a transition detection unit 104, a transition reduction unit 106 and a receiver 108. The transmitter 102, located in a timing controller (not shown) rearranging the RGB data from a video processing system (not shown), receives data to be transmitted to a receiver 108 located in a source driver. The transmitter 102 provides data through data signals RSR0, RSR1, RSR2, RSG0, RSG1, RSG2, RSB0, RSB1 and RSB2 to the transition detection unit 104 and transition reduction unit 106. Each value of pixels of red, green and blue provided by the transmitter 102 is represented by, for example, 6 bits. The transition detection unit 104 selectively asserts detection signals POL20 and POL21 in response to the data signals RSR0, RSR1, RSR2, RSG0, RSG1, RSG2, RSB0, RSB1 and RSB2. The transition reduction unit 106 generates data signals RSR0', RSR1', RSR2', RSG0', RSG1', RSG2', RSB0', RSB1' and RSB2' by inverting the data signals RSR0, RSR1, RSR2, RSG0, RSG1, RSG2, RSB0, RSB1, RSB2 when the detection signals POL20 or POL21 is asserted. The receiver 108 restores the data provided by the transmitter 102 from the data signals RSR0', RSR1', RSR2', RSG0', RSG1', RSG2', RSB0', RSB1' and RSB2', and the detection signals POL20 and POL21.

Figure 3:
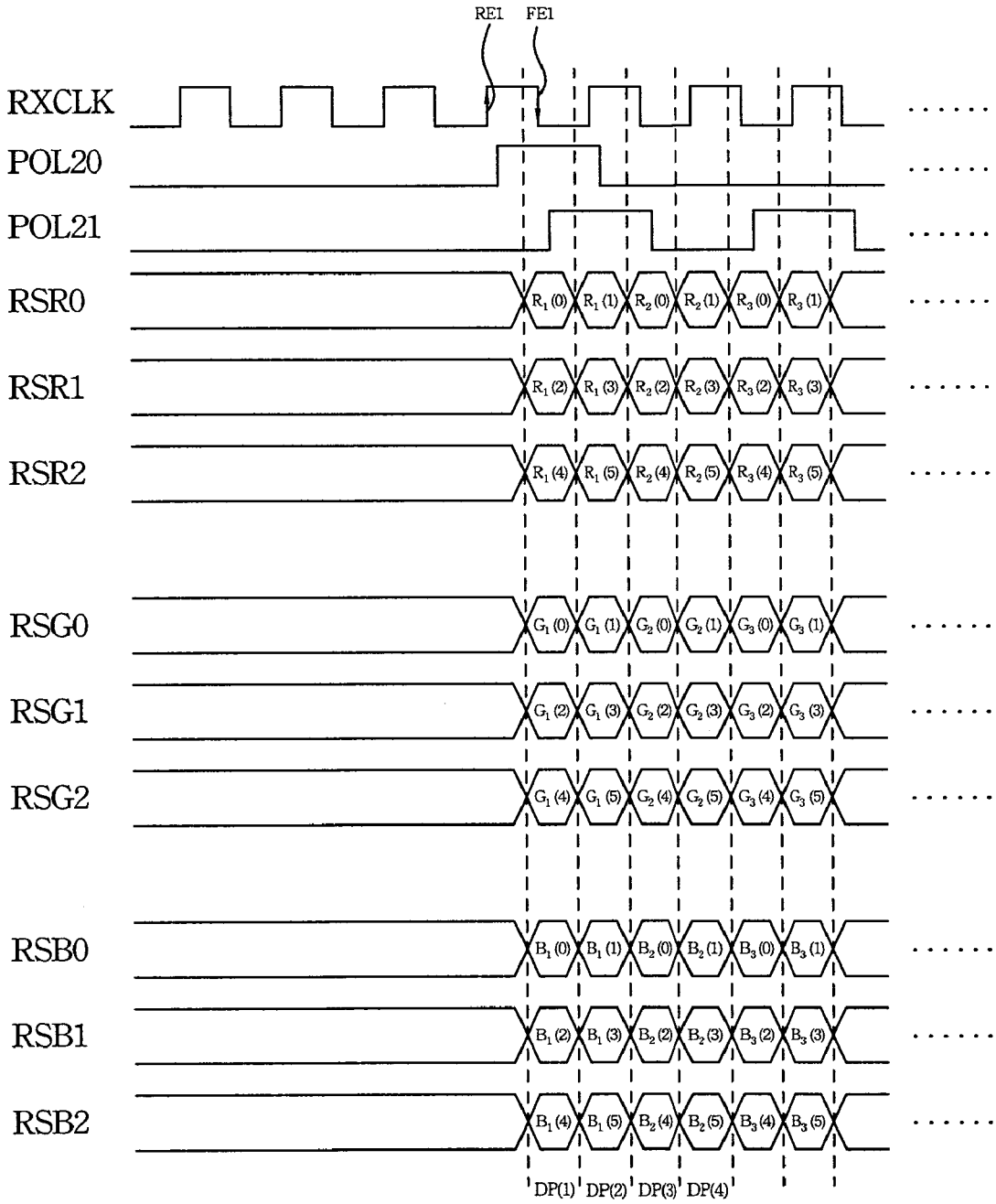
FIG. 3 is a diagram showing the timing of the signals used in the interface circuit according to the preferred embodiment of the present invention.

FIG. 3 is a diagram showing the timing of the signals used in the interface circuit 100. The details of the operation of the interface circuit 100 will be explained in the following, with reference to FIG. 3.

The transmitter 102 provides data through data signals RSR0, RSR1, RSR2, RSG0, RSG1, RSG2, RSB0, RSB1 and RSB2 during the data periods corresponding to rising edges and falling edges of a clock signal RXCLK. More specifically, the bits $R_1(0)$, $R_1(1)$, $R_1(2)$, $R_1(3)$, $R_1(4)$ and $R_1(5)$ representing the value of the first red pixel are divided into two groups, one includes bits $R_1(0)$, $R_1(2)$, $R_1(4)$ and the other includes bits $R_1(1)$, $R_1(3)$, $R_1(5)$. In the first group, the bits $R_1(0)$, $R_1(2)$, $R_1(4)$ are transmitted respectively through the signals RSR0, RSR1 and RSR2 in parallel during the data period DP(1) corresponding to the falling edge FE1 of the clock signal RXCLK. In the second group, the bits $R_1(1)$, $R_1(3)$, $R_1(5)$ are transmitted respectively through the signals RSR0, RSR1 and RSR2 in parallel during the data period DP(2) corresponding to the rising edge RE1 of the clock signal RXCLK. Similarly, the bits $G_1(0)$, $G_1(1)$, $G_1(2)$, $G_1(3)$, $G_1(4)$ and $G_1(5)$ representing the value of the first green pixel are divided into two groups, one includes bits $G_1(0)$, $G_1(2)$, $G_1(4)$ and the other includes bits $G_1(1)$, $G_1(3)$, $G_1(5)$. In the first group, the bits $G_1(0)$, $G_1(2)$, $G_1(4)$ are transmitted respectively through the signals RSG0, RSG1 and RSG2 in parallel during the data period DP(1) corresponding to the falling edge FE1 of the clock signal RXCLK. In the second group, the bits $G_1(1)$, $G_1(3)$, $G_1(5)$ are transmitted respectively through the signals RSG0, RSG1 and RSG2 in parallel during the data period DP(2) corresponding to the rising edge RE1 of the clock signal RXCLK. The bits $B_1(0)$, $B_1(1)$, $B_1(2)$, $B_1(3)$, $B_1(4)$ and $B_1(5)$ representing the value of the first blue pixel are divided into two groups, one includes bits $B_1(0)$, $B_1(2)$, $B_1(4)$ and the other includes bits $B_1(1)$, $B_1(3)$, $B_1(5)$. In the first group, the bits $B_1(0)$, $B_1(2)$, $B_1(4)$ are transmitted respectively through the signals RSB0, RSB1 and RSB2 in parallel during the data period DP(1) corresponding to the falling edge FE1 of the clock signal RXCLK. In the second group, the bits $B_1(1)$, $B_1(3)$, $B_1(5)$ are transmitted respectively through the signals RSB0, RSB1 and RSB2 in parallel during the data period DP(2) corresponding to the rising edge RE1 of the clock signal RXCLK. The values of the second, third and all the following red, green and blue pixels are transmitted in a way the same as the above.

The transition detection unit 104 selectively asserts detection signals POL20 and POL21 in response to the number of the data signals RSR0, RSR1, RSR2, RSG0, RSG1, RSG2, RSB0, RSB1 and RSB2 having transitions between every two adjacent data periods. The detection signals POL20 is asserted if more than half of the number of the data signals RSR0, RSR1, RSR2, RSG0, RSG1, RSG2, RSB0, RSB1 and RSB2 have transitions between the two adjacent data periods DP($2n$) and DP($2n$+1), while the detection signals POL21 is asserted if more than half of the number of the data signals RSR0, RSR1, RSR2, RSG0, RSG1, RSG2, RSB0, RSB1 and RSB2 have transitions between the two adjacent data periods DP($2n$−1) and DP($2n$), wherein n is a natural number. More specifically, in the data period DP(1), the transmitted bits $R_1(0)$, $R_1(2)$, $R_1(4)$, $G_1(0)$, $G_1(2)$, $G_1(4)$, $B_1(0)$, $B_1(2)$ and $B_1(4)$ are respectively 0, 0, 0, 1, 1, 0, 1, 0 and 1, while the transmitted bits $R_1(1)$, $R_1(3)$, $R_1(5)$, $G_1(1)$, $G_1(3)$, $G_1(5)$, $B_1(1)$, $B_1(3)$ and $B_1(5)$ are respectively 1, 0, 0, 0, 0, 0, 0, 0 and 1 in the data period DP(2). Since the levels of the data signals RSR0, RSG0, RSG1 and RSB0 changed from 1 to 0 or from 0 to 1, they have transitions between the two adjacent data periods DP(1) and DP(2). However, since the number of the data signals having transitions is 4, which is smaller than half of the number of the data signals, the transition detection unit 104 de-asserts the detection signal POL21. In the data period DP(3), the transmitted bits $R_2(0)$, $R_2(2)$, $R_2(4)$, $G_2(0)$, $G_2(2)$, $G_2(4)$, $B_2(0)$, $B_2(2)$ and $B_2(4)$ are respectively 1, 0, 0, 0, 0, 0, 1, 0 and 1. Since only the level of the data signal RSB0 changed from 0 to 1 between the two adjacent data periods DP(2) and DP(3), the transition detection unit 104 de-asserts the detection signal POL20. In the data period DP(4), the transmitted bits $R_2(1)$, $R_2(3)$, $R_2(5)$, $G_2(1)$, $G_2(3)$, $G_2(5)$, $B_2(1)$, $B_2(3)$ and $B_2(5)$ are respectively 0, 1, 1, 1, 1, 1, 1, 0 and 1. Since the levels of the data signals RSR0, RSR1, RSR2, RSG0, RSG1 and RSG2 changed from 0 to 1 or from 1 to 0 between the two adjacent data periods DP(3) and DP(4), the transition detection unit 104 asserts the detection signal POL21.

The transition reduction unit 106 generates data signals RSR0', RSR1', RSR2', RSG0', RSG1', RSG2', RSB0', RSB1' and RSB2' by selectively outputting the inverted and non-inverted data signals RSR0, RSR1, RSR2, RSG0, RSG1, RSG2, RSB0, RSB1 and RSB2 in response to the assertion and de-assertion of the detection signals POL20 and POL21. More specifically, since the detection signal POL21 is de-asserted when the transition reduction unit 106 receives the bits $R_1(1)$, $R_1(3)$, $R_1(5)$, $G_1(1)$, $G_1(3)$, $G_1(5)$, $B_1(1)$, $B_1(3)$ and $B_1(5)$, the transition reduction unit 106 outputs the non-inverted data signals RSR0, RSR1, RSR2, RSG0, RSG1, RSG2, RSB0, RSB1 and RSB2 as the signals RSR0', RSR1', RSR2', RSG0', RSG1', RSG2', RSB0', RSB1' and RSB2'. Similarly, since the detection signal POL20 is de-asserted when the transition reduction unit 106 receives the bits $R_2(0)$, $R_2(2)$, $R_2(4)$, $G_2(0)$, $G_2(2)$, $G_2(4)$, $B_2(0)$, $B_2(2)$ and $B_2(4)$, the transition reduction unit 106 outputs the non-inverted data signals RSR0, RSR1, RSR2, RSG0, RSG1, RSG2, RSB0, RSB1 and RSB2 as the signals RSR0', RSR1', RSR2', RSG0', RSG1', RSG2', RSB0', RSB1' and RSB2'. However, when the transition reduction unit 106 receives the bits $R_2(1)$, $R_2(3)$, $R_2(5)$, $G_2(1)$, $G_2(3)$, $G_2(5)$, $B_2(1)$, $B_2(3)$ and $B_2(5)$, the detection signal POL21 is asserted. The transition reduction unit 106 inverts the data signals RSR0, RSR1, RSR2, RSG0, RSG1, RSG2, RSB0, RSB1 and RSB2, and output them as the signals RSR0', RSR1', RSR2', RSG0', RSG1', RSG2', RSB0', RSB1' and RSB2'.

The receiver 108 restores the data provided by the transmitter 102 from the data signals RSR0', RSR1', RSR2', RSG0', RSG1', RSG2', RSB0', RSB1' and RSB2', and the detection signals POL20 and POL21. More specifically, since the detection signal POL21 is de-asserted when the receiver 108 receives the bits $R_1(1)$, $R_1(3)$, $R_1(5)$, $G_1(1)$, $G_1(3)$, $G_1(5)$, $B_1(1)$, $B_1(3)$ and $B_1(5)$, the receiver 108 identifies the bits carried by the signals RSR0', RSR1', RSR2', RSG0', RSG1', RSG2', RSB0', RSB1' and RSB2' as those provided by the transmitter 102. Similarly, since the detection signal POL20 is de-asserted when the receiver 108 receives the bits $R_2(0)$, $R_2(2)$, $R_2(4)$, $G_2(0)$, $G_2(2)$, $G_2(4)$, $B_2(0)$, $B_2(2)$ and $B_2(4)$, the receiver 108 identifies the bits carried by the signals RSR0', RSR1', RSR2', RSG0', RSG1', RSG2', RSB0', RSB1' and RSB2' as those provided by the transmitter 102. However, when the receiver 108 receives the bits $R_2(1)$, $R_2(3)$, $R_2(5)$, $G_2(1)$, $G_2(3)$, $G_2(5)$, $B_2(1)$, $B_2(3)$ and $B_2(5)$, the detection signal POL21 is asserted. The receiver 108 identifies the complements of the bits carried by the data signals RSR0, RSR1, RSR2, RSG0, RSG1, RSG2, RSB0, RSB1 and RSB2, as those provided by the transmitter 102.

Thus, in the previously described interface circuit, each 6-bit pixel value are transmitted within one period of the clock signal through only 3 data signals, which halves the number of the wire lines between the timing controller and source driver in comparison with the conventional RSDS or TTL interface circuit. Moreover, the transitions occurring in the data signals are reduced, which alleviates the EMI issue in double data rate transmission.

As is understood by a person skilled in the art, the foregoing preferred embodiments of the present invention are strengths of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. An interface circuit whereby data is transmitted through first data signals during a first data period, a second data period, and a third data period respectively corresponding to a first rising, a first falling edge, and a second rising edge of a clock signal, wherein the first data period, the second data period, and the third data period are continuous, the second data period follows the first period, and the third data period follows the second data period, the interface circuit comprising:

a transition detection unit for selectively asserting a first detection signal, of which a constant level of the first detection signal lasts longer than a ½ cycle of the clock signal, in response to the number of the first data signals having transitions between the first data period and the second data period, and selectively asserting a second detection signal, of which a constant level of the first detection signal lasts longer than a ½ cycle of the clock signal, in response to the number of the first data signals having transitions between the second data period and the third data period; and a transition reduction unit for generating second data signals by outputting the inverted and non-inverted first data signals respectively when the first detection signal or the second detection signal is asserted and de-asserted.

2. The interface circuit as claimed in claim 1, wherein the first detection signal or the second detection signal is asserted when the number of the first data signals having transitions is greater than a threshold.

3. The interface circuit as claimed in claim 2, wherein the threshold is half of the number of the first data signals.

4. An interface circuit comprising:

a transmitter for providing data through first data signals during a first data period, a second data period and a third data period respectively corresponding to a first rising edge, a first falling edge, and a second rising edge of a clock signal, wherein the first data period, the second data period, and the third data period are continuous, the second data period follows the first period, and the third data period follows the second data period;

a transition detection unit for selectively asserting a first detection signal, of which a constant level lasts longer than a ½ cycle of the clock signal, in response to the number of the first data signals having transitions between the first data period and the second data period, and selectively asserting a second detection signal, of which a constant level of the second detection signal lasts longer than a ½ cycle of the clock signal, in response to the number of the first data signals having transitions between the second data period and the third data period;

a transition reduction unit for generating second data signals by outputting the inverted and non-inverted first data signals respectively when the first detection signal or the second detection signal is asserted and de-asserted; and a receiver for restoring the data from the second data signals using the first detection signal and second detection signal.

5. The interface circuit as claimed in claim 4, wherein the data is transmitted from a timing controller to a source driver of an LCD.

6. The interface circuit as claimed in claim 4, wherein the first detection signal or the second detection signal is asserted when the number of the first data signals having transitions is greater than a threshold.

7. The interface circuit as claimed in claim 6, wherein the threshold is half of the number of the first data signals.

8. The interface circuit as claimed in claim 4, wherein the data restored by the receiver is substantially the same as the data provided by the transmitter.

9. The interface circuit as claimed in claim 4, wherein the transmitter and the receiver are located in a timing controller and a source driver of an LCD respectively.

* * * * *